US011905948B2

(12) United States Patent
Saga et al.

(10) Patent No.: US 11,905,948 B2
(45) Date of Patent: Feb. 20, 2024

(54) VARIABLE DISPLACEMENT OIL PUMP INCLUDING SWING MEMBER

(71) Applicant: HITACHI AUTOMOTIVE SYSTEMS, LTD., Hitachinaka (JP)

(72) Inventors: Koji Saga, Ebina (JP); Yasushi Watanabe, Kanagawa (JP); Hideaki Ohnishi, Atsugi (JP); Atsushi Naganuma, Atsugi (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 406 days.

(21) Appl. No.: 15/737,595

(22) PCT Filed: Mar. 31, 2016

(86) PCT No.: PCT/JP2016/060702
§ 371 (c)(1),
(2) Date: Dec. 18, 2017

(87) PCT Pub. No.: WO2016/203811
PCT Pub. Date: Dec. 22, 2016

(65) Prior Publication Data

US 2018/0187676 A1 Jul. 5, 2018

(30) Foreign Application Priority Data

Jun. 19, 2015 (JP) ..... 2015-123391

(51) Int. Cl.
*F04C 14/22* (2006.01)
*F04C 2/344* (2006.01)
(Continued)

(52) U.S. Cl.
CPC ..... *F04C 14/226* (2013.01); *F01M 1/02* (2013.01); *F04C 2/344* (2013.01); *F04C 2/3441* (2013.01);
(Continued)

(58) Field of Classification Search
CPC ..... F01M 1/02; F01M 2001/0238; F01M 2001/0246; F01M 2001/0269;
(Continued)

(56) References Cited

U.S. PATENT DOCUMENTS 8,545,200 B2 * 10/2013 Watanabe ..... F04C 14/226 418/24
8,684,702 B2 * 4/2014 Watanabe ..... F04C 14/226 417/220
(Continued)

FOREIGN PATENT DOCUMENTS

JP S59-070891 A 4/1984
JP 2000-104671 A 4/2000
(Continued)

OTHER PUBLICATIONS

English Translation of JP 2014-105622A, translated from Espacenet on Dec. 11, 2019.*
(Continued)

*Primary Examiner* — Essama Omgba
*Assistant Examiner* — Paul W Thiede
(74) *Attorney, Agent, or Firm* — FOLEY & LARDNER LLP

(57) ABSTRACT

In a variable displacement type oil pump, a swing member accommodates a pump forming member, and swings to vary a quantity of change of a volumetric capacity of each pump chamber. A biasing member biases the swing member in a direction to increase the quantity of change of the volumetric capacity of each pump chamber. A first control oil chamber applies a first torque to the swing member in a direction to reduce the quantity of change of the volumetric capacity of each pump chamber. A second control oil chamber applies a second torque to the swing member in a direction to increase the quantity of change of the volumetric capacity of each
(Continued)

pump chamber, wherein the second torque is larger than the first torque. A switching mechanism switches between supply and drain of working oil with respect to the second control oil chamber.

11 Claims, 11 Drawing Sheets

(51) Int. Cl.
*F01M 1/02* (2006.01)
*F04C 13/00* (2006.01)
*F04C 15/00* (2006.01)
*F04C 15/06* (2006.01)

(52) U.S. Cl.
CPC ..... *F04C 13/001* (2013.01); *F04C 15/0003* (2013.01); *F04C 15/008* (2013.01); *F04C 15/06* (2013.01); *F01M 2001/0238* (2013.01); *F01M 2001/0246* (2013.01); *F01M 2001/0269* (2013.01); *F04C 2210/206* (2013.01)

(58) Field of Classification Search
CPC .. F04C 13/001; F04C 14/226; F04C 15/0003; F04C 15/008; F04C 15/06; F04C 2210/206; F04C 2/344; F04C 2/3441
USPC ..... 418/24, 26, 28
See application file for complete search history.

(56) References Cited

U.S. PATENT DOCUMENTS 9,017,049 B2 4/2015 Gasperini
9,133,842 B2 9/2015 Watanabe
9,410,514 B2 * 8/2016 Watanabe ..... F04C 14/226
9,494,152 B2 11/2016 Saga
9,534,596 B2 * 1/2017 Watanabe ..... F04C 2/3442
10,161,398 B2 * 12/2018 Saga ..... F04C 2/344
2009/0022612 A1 * 1/2009 Williamson ..... F04C 2/04 418/24
2010/0226799 A1 * 9/2010 Watanabe ..... F04C 14/226 417/364
2011/0194967 A1 * 8/2011 Watanabe ..... F04C 14/226 418/138
2012/0213655 A1 * 8/2012 Ohnishi ..... F04C 2/3442 418/24
2012/0301342 A1 * 11/2012 Ohnishi ..... F04C 2/3442 418/25
2013/0164162 A1 * 6/2013 Saga ..... F04C 2/344 418/24
2013/0164163 A1 6/2013 Ohnishi et al.
2014/0072456 A1 * 3/2014 Watanabe ..... F04B 49/002 417/218
2014/0147322 A1 * 5/2014 Saga ..... F04C 2/344 418/24
2014/0147323 A1 * 5/2014 Watanabe ..... F04C 14/226 418/27
2014/0182541 A1 * 7/2014 Yi ..... F01M 1/16 123/196 AB
2014/0219847 A1 * 8/2014 Watanabe ..... F04C 2/3442 418/24
2015/0218983 A1 8/2015 Watanabe et al.
2015/0252803 A1 * 9/2015 Ohnishi ..... F04C 2/344 418/26
2016/0153325 A1 * 6/2016 Saga ..... F01M 1/16 418/24

FOREIGN PATENT DOCUMENTS

JP 2002-147373 A 5/2002
JP 2013-527379 A 6/2013
JP 2013-130089 A 7/2013
JP 2014-105622 A 6/2014
JP 2010-209718 A 9/2020
WO WO-2006/066405 A1 6/2006
WO WO-2014/038302 A1 3/2014

OTHER PUBLICATIONS

English Machine Translation of JP2014-105622A translated by Espacenet on Apr. 30, 2020. (Year: 2014).*
Office Action issued in corresponding Japanese application No. 2019-221936 dated Sep. 15, 2020 with English translation.

* cited by examiner

VARIABLE DISPLACEMENT OIL PUMP INCLUDING SWING MEMBER

TECHNICAL FIELD

The present invention relates to a variable displacement type oil pump for oil supply for lubrication of a slide part such as a crankshaft of an internal combustion engine, and/or for driving of auxiliary equipment of the internal combustion engine.

BACKGROUND ART

Various variable displacement type oil pumps have been provided. A patent document 1 discloses a variable displacement type oil pump as follows.

This variable displacement type oil pump is configured to satisfy a required two-stage characteristic including a low pressure characteristic related to a first rotation region and a high pressure characteristic related to a second rotation region, for application to devices having different request discharge pressures, such as sliding parts such as bearing metal pieces of a crankshaft of an internal combustion engine, and a variable valve device for controlling characteristics of operation of engine valves such as intake valves.

Specifically, a first control oil chamber and a second control oil chamber are formed between an inner peripheral surface of a pump body and an outer peripheral surface of a cam ring; a pump discharge pressure is supplied to the first control oil chamber so as to bias the cam ring in a direction to reduce a quantity of eccentricity of the cam ring (henceforth referred to as coaxial direction); and the pump discharge pressure is supplied to the second control oil chamber so as to bias the cam ring in a direction to increase the quantity of eccentricity of the cam ring (henceforth referred to as eccentric direction). The cam ring is biased by a spring force of a coil spring in a direction to increase the quantity of eccentricity of the cam ring; and a plurality of pump chambers defined by an inner peripheral surface of the cam ring and a plurality of vanes configured to be out of and in an outer peripheral surface of a rotor, wherein internal pressures of the pump chambers cause another biasing force for swing control of the cam ring in the eccentric direction or in the coaxial direction.

Supply and drain of the discharge pressure with respect to the first and second control oil chambers is controlled by an electromagnetic switching valve and a pilot valve so as to control the quantity of eccentricity of the cam ring in accordance with engine rotational speed, thereby satisfying the two-stage request discharge pressure having the low pressure characteristic and the high pressure characteristic.

PRIOR ART DOCUMENT(S)

Patent Document(s)

Patent Document 1: JP 2014-105622 A

SUMMARY OF THE INVENTION

Problem(s) to be Solved by the Invention

In case of the variable displacement type oil pump described above, especially when the pump is rotating at high speed (in the second rotation region), it is likely that many bubbles occur in oil due to aeration and/or cavitation in a process of suction. This causes a phenomenon of collapse and others of the bubbles in a discharge region where oil is compressed and discharged, and thereby brings the internal pressures of the pump chambers out of balance. This may cause behavior of the cam ring to be unstable so that the cam ring swings in the coaxial direction before a set operating oil pressure is reached, and cause control of the high pressure characteristic of the second rotation region to be unstable.

The present invention is made with attention to the technical problem described above, and is targeted for providing a variable displacement type oil pump which is capable of suppressing behavior of a cam ring from becoming unstable even when bubbles occur in pump chambers, and thereby stabilizing control of a high pressure characteristic of the pump.

Means for Solving the Problem(s)

According to the present invention, a variable displacement type oil pump comprises: a pump forming member configured to be rotationally driven so as to change a volumetric capacity of each of a plurality of pump chambers, and suck working oil through a suction part, and discharge working oil through a discharge part; a swing member configured to accommodate the pump forming member inside of the swing member, and swing about a swing fulcrum so as to vary a quantity of change of the volumetric capacity of each of the plurality of pump chambers opened to the discharge part, wherein the swing fulcrum is set at an outer periphery of the swing member; a biasing member mounted with application of a setting load so as to bias the swing member in a direction to increase the quantity of change of the volumetric capacity of each of the plurality of pump chambers; a first control oil chamber configured to be supplied with working oil so as to apply a first torque to the swing member in a direction to reduce the quantity of change of the volumetric capacity of each of the plurality of pump chambers; a second control oil chamber configured to be supplied with working oil so as to apply a second torque to the swing member in a direction to increase the quantity of change of the volumetric capacity of each of the plurality of pump chambers, wherein the second torque is larger than the first torque; and a switching mechanism configured to switch between supply of working oil to the second control oil chamber and drain of working oil from the second control oil chamber.

Effect(s) of the Invention

The present invention serves to suppress behavior of the cam ring from becoming unstable, and thereby stabilize control of the pump under the high pressure characteristic.

BRIEF DESCRIPTION OF THE DRAWINGS

FIG. 7A shows a state of a section "a" in FIG. 6, and FIG. 7B shows a state of a section "b" in FIG. 6.

FIG. 8A shows a state of a section "c" in FIG. 6, and FIG. 8B shows a state of a section "d" in FIG. 6.

MODE(S) FOR CARRYING OUT THE INVENTION

Figure 1:
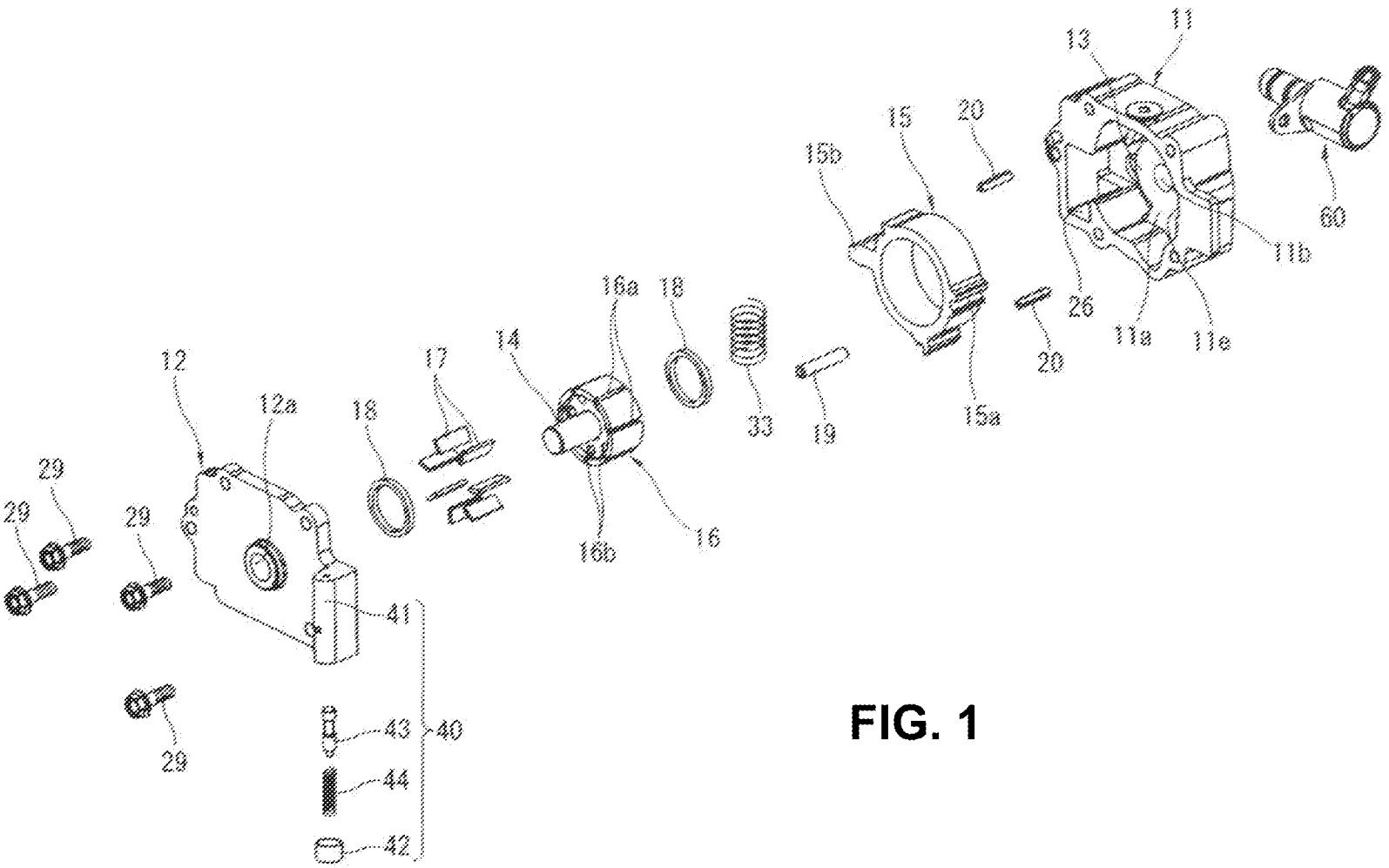
FIG. 1 is an exploded perspective view showing components of a variable displacement type oil pump according to the present invention.
Figure 2:
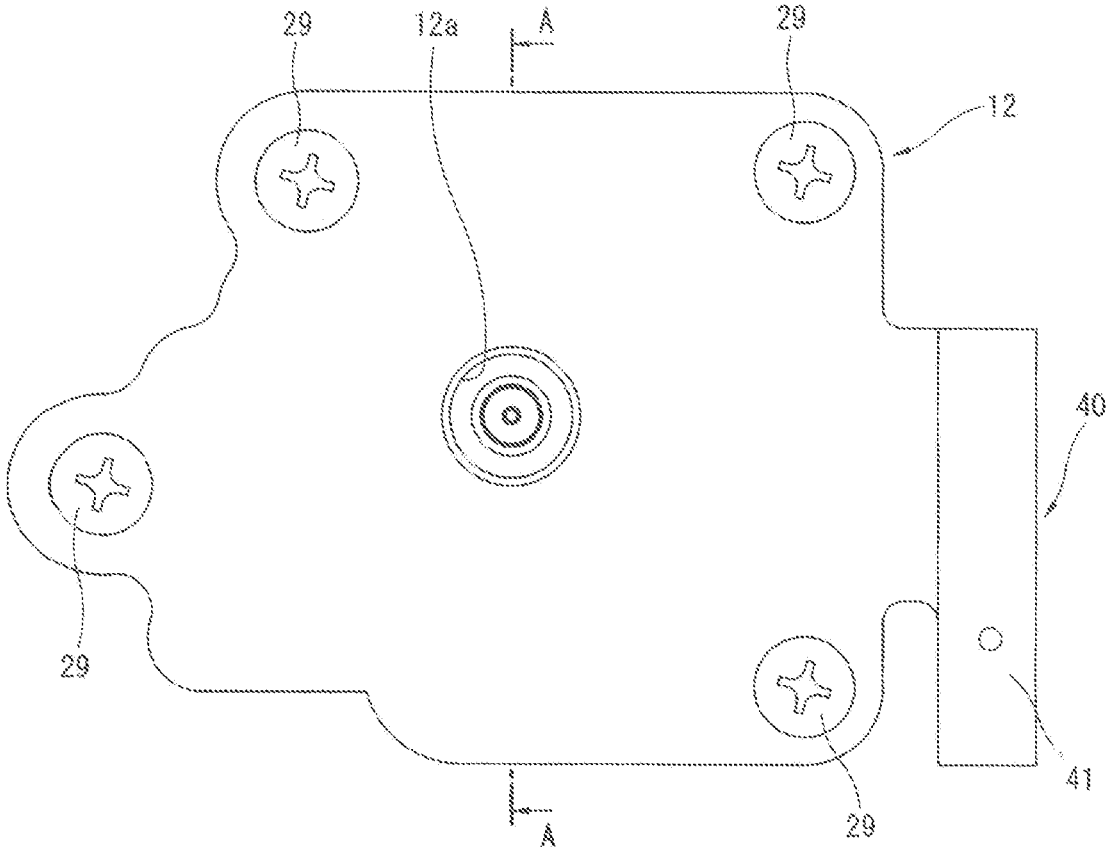
FIG. 2 is a front view of the variable displacement type oil pump shown in FIG. 1.

The following describes a variable displacement type oil pump according to an embodiment of the present invention in detail with reference to the drawings. The variable displacement type oil pump according to the present embodiment is exemplified as an oil pump for supply of engine lubricating oil to sliding parts of an internal combustion engine of an automotive vehicle, and/or to a valve timing control device employed for control of opening and closing timings of engine valves of the internal combustion engine.

This oil pump 10 is provided at a front end part of a cylinder block or balancer device of an internal combustion engine not shown. As shown in FIGS. 1 to 4, oil pump 10 includes: a pump housing including a pump body 11 and a cover member 12, wherein pump body 11 includes a first end side opened, and has a U-shaped longitudinal section, and forms a pump accommodation chamber 13 inside, and wherein cover member 12 closes the opening of the first end of pump body 11; a drive shaft 14 rotatably supported by the pump housing, and configured to be rotationally driven by a crankshaft or balancer shaft not shown, wherein drive shaft 14 extends through a substantially central portion of pump accommodation chamber 13; a cam ring 15 accommodated in pump accommodation chamber 13 for movement (swing), and configured as a swing member to vary a quantity of change of a volumetric capacity of each of pump chambers 24 described below as operating oil chambers, in cooperation with first and second control oil chambers 31, 32 and a coil spring 33 described below; a pump forming member accommodated radially inside of cam ring 15, and configured to be rotationally driven by drive shaft 14 in a clockwise direction in FIG. 4 so as to increase and reduce the volumetric capacity of each pump chamber 24 defined between the pump forming member and cam ring 15, and thereby perform a pumping action; a pilot valve 40 coupled to cover member 12, and configured as a control mechanism to control supply and drain of oil pressure to and from second control oil chamber 32 described below; and an electromagnetic switching valve 60 disposed in an oil passage (second introduction passage 72 described below) formed between pilot valve 40 and a discharge opening 22*a* described below, and configured as a switching mechanism to perform a switching control of supply of discharged oil to pilot valve 40.

The pump forming member includes: a rotor 16 accommodated rotatably radially inside of cam ring 15, and including a central portion coupled to an outer periphery of drive shaft 14; vanes 17 each of which is accommodated in a corresponding one of slits 16*a* so as to be out of and in slit 16*a*, wherein slits 16*a* are formed at an outer periphery of rotor 16 and extending radially; and a pair of ring members 18, 18 disposed at corresponding sides of an inside portion of rotor 16.

Figure 5:
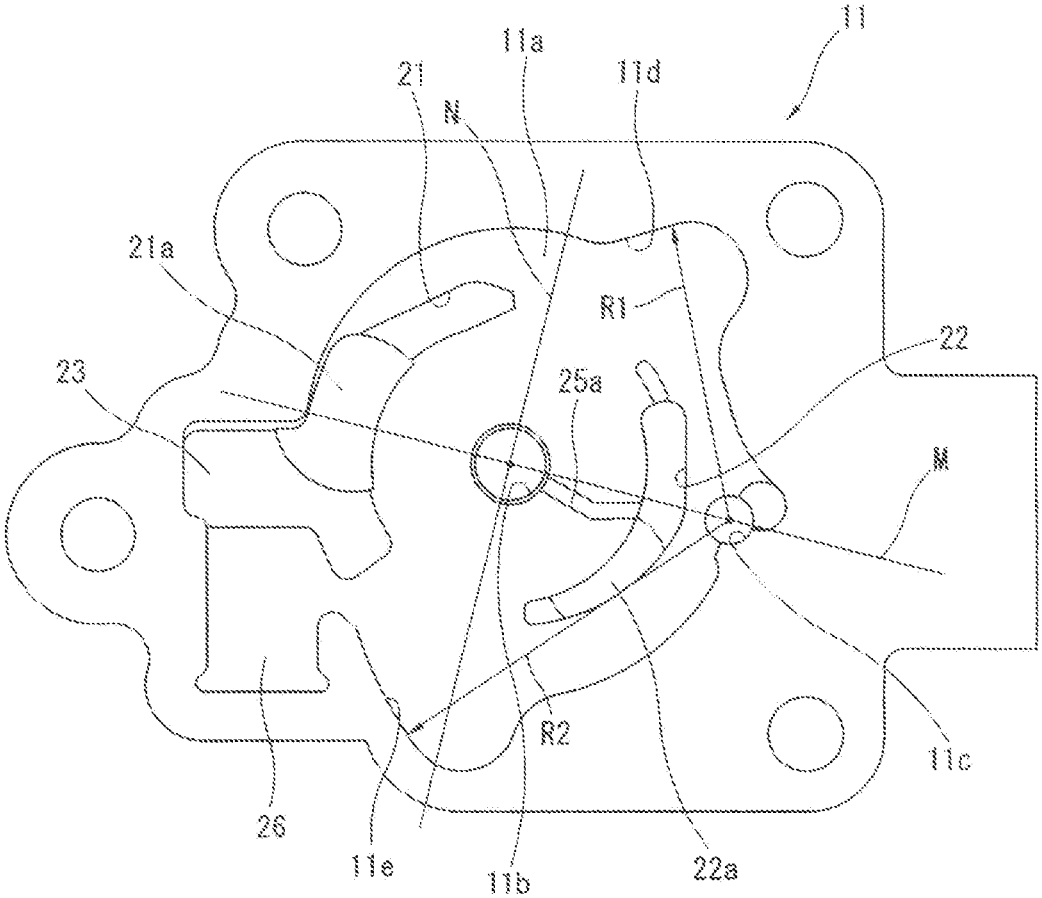
FIG. 5 is a view of a pump body according to the present embodiment from a side where a cover member is placed on the pump body.

Pump body 11 is formed integrally of an aluminum alloy, and includes an end wall 11*a* as a first end wall of pump accommodation chamber 13, wherein a bearing hole 11*b* is formed at a substantially central portion of end wall 11*a*, and is configured to support a first end portion of drive shaft 14 rotatably, as also shown in FIG. 5. A support hole 11*c* is formed as a recess at a predetermined portion of an inner peripheral wall of pump accommodation chamber 13, and has a substantially semicircular section for supporting the cam ring 15 via a rodlike pivot pin 19 for swing of cam ring 15.

Figure 4:
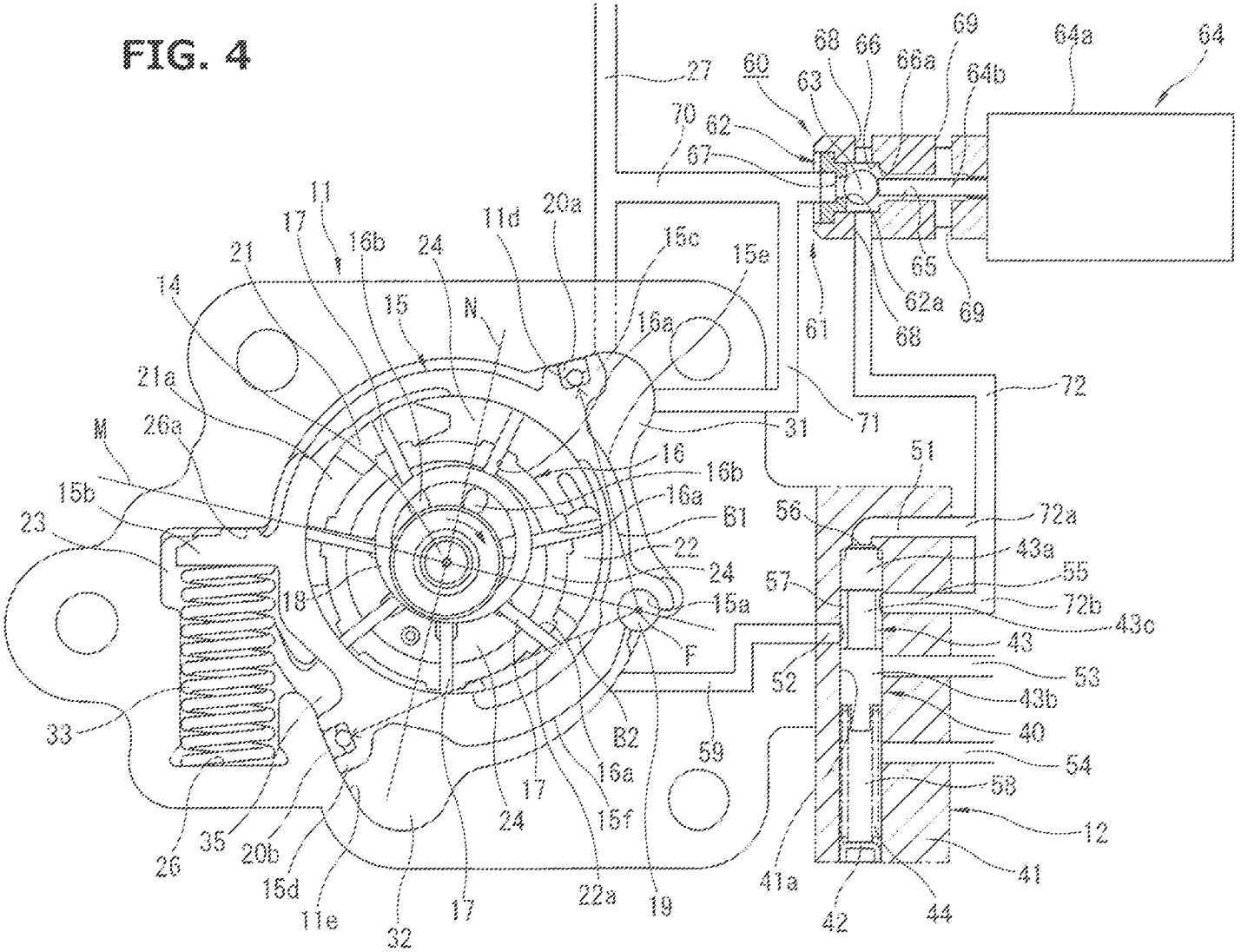
FIG. 4 is a sectional view taken along a line B-B in FIG. 3.

The inner peripheral wall of pump accommodation chamber 13 further includes a first seal slide surface 11*d* configured to be in sliding contact with a first seal member 20*a* provided at an outer periphery of cam ring 15, wherein first seal slide surface 11*d* is located above a line M (henceforth referred to as cam ring reference line) in FIG. 4, where line M connects a center of bearing hole 11*b* and a center of support hole 11*c*. The first seal slide surface 11*d* is formed to have an arc shape having a predetermined semidiameter R1 from the center of support hole 11*c*, and have a length in a circumferential direction such that first seal slide surface 11*d* is constantly in sliding contact with first seal member 20*a* while cam ring 15 swings with eccentricity within its range of swing. Similarly, a second seal slide surface 11*e* is formed below the cam ring reference line M in FIG. 4, and is configured to be in sliding contact with a second seal member 20*b* provided at the outer periphery of cam ring 15. The second seal slide surface 11*e* is formed to have an arc shape having a predetermined semidiameter R2 from the center of support hole 11*c*, and have a length in a circumferential direction such that second seal slide surface 11*e* is constantly in sliding contact with second seal member 20*b* while cam ring 15 swings with eccentricity within its range of swing.

As shown in FIGS. 4 and 5 in particular, the inside surface of the end wall 11*a* of pump body 11 is formed with a suction port 21 and a discharge port 22 as recesses, wherein suction port 21 is a suction part in the form of a recess having a substantially arc shape, and is opened in a region radially outside of bearing hole 11*b* where the volumetric capacity of each pump chamber 24 increases along with pumping action by the pump forming member (henceforth referred to as suction region), and wherein discharge port 22 is a discharge part in the form of a recess having a substantially arc shape, and is opened in a region radially outside of bearing hole 11*b* where the volumetric capacity of each pump chamber 24 decreases along with pumping action by the pump forming member (henceforth referred to as discharge region), and wherein suction port 21 and discharge port 22 are substantially opposite to each other through the bearing hole 11*b*.

Suction port 21 includes: an introduction portion 23 formed integrally at its substantially central portion in a circumferential direction, wherein introduction portion 23 extends to a spring accommodation chamber 26 described below; and a suction opening 21*a* formed in vicinity to a boundary between introduction portion 23 and suction port 21, and extending through the end wall 11*a* of pump body 11 to the outside. In this configuration, oil stored in an oil pan not shown of the internal combustion engine is sucked to into each pump chamber 24 in the suction region via the suction opening 21*a* and suction port 21, under a negative pressure caused by the pumping action of the pump forming member.

The suction opening 21*a* is configured to communicate with introduction portion 23 and a low-pressure chamber 35, wherein low-pressure chamber 35 is formed in the suction region radially outside of cam ring 15, and wherein low-pressure oil (the suction pressure) is introduced also into low-pressure chamber 35.

Discharge port 22 includes a starting end portion formed with discharge opening 22*a*, wherein discharge opening 22*a* extends through the end wall 11*a* of pump body 11 and opens to the outside. Accordingly, oil is discharged to discharge port 22 under pressure by the pumping action of the pump forming member, and is supplied through the discharge opening 22*a* and a main oil gallery 27, which is formed inside of the cylinder block, for lubrication of sliding parts of the engine and for driving of the valve timing control device.

The inside surface of end wall 11*a* is formed with a communication groove 25*a* as a recess configured to allow communication between discharge port 22 and bearing hole 11*b*, wherein oil is supplied to bearing hole 11*b* through the communication groove 25*a*, and is supplied also to side portions of rotor 16 and vanes 17 for ensuring preferable lubrication of the sliding parts.

Figure 3:
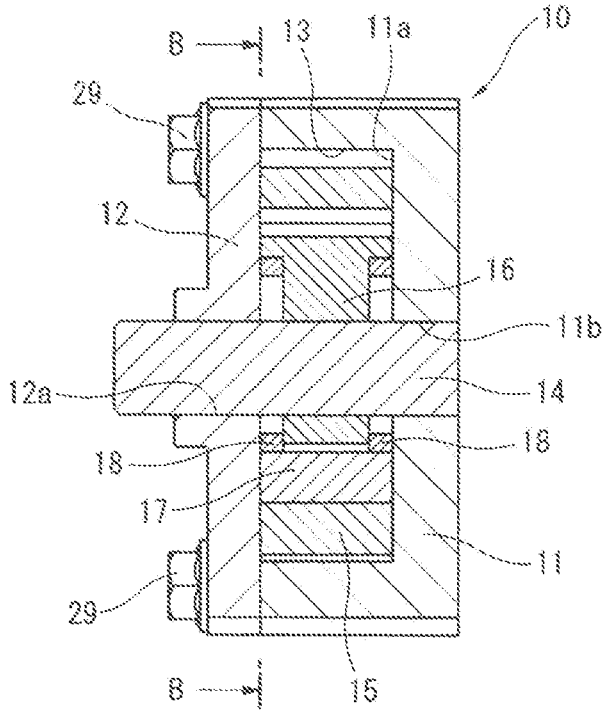
FIG. 3 is a sectional view taken along a line A-A in FIG. 2.

As shown in FIGS. 1 and 3, cover member 12 has a substantially plate shape, and is attached to the open end surface of pump body 11 by a plurality of bolts 29, and includes a bearing hole 12*a* at a position facing the bearing hole 11*b* of pump body 11, wherein bearing hole 12*a* supports a second end side of drive shaft 14 rotatably. The inside surface of cover member 12 also includes a suction port, a discharge port, and a communication groove not shown, which are arranged to face the suction port 21, discharge port 22, and communication groove 25*a* of pump body 11, respectively.

As shown in FIG. 3, drive shaft 14 includes a first axial end portion extending through the cover member 12 to the outside and coupled to the crankshaft or the like, and is configured to be rotated by a torque transmitted from the crankshaft or the like so as to rotate the rotor 16 in the clockwise direction in FIG. 4. As shown in FIG. 4, a line N (henceforth referred to as cam ring eccentric-direction line), which passes through the center of drive shaft 14, and perpendicularly crosses the cam ring reference line M, is a line of boundary between the suction region and the discharge region.

As shown in FIGS. 1 and 4, rotor 16 is formed with slits 16*a* as recesses extending radially and outwardly from the central side of rotor 16, and back pressure chambers 16*b* at proximal end portions of corresponding slits 16*a*, wherein each back pressure chamber 16*b* has a substantially circular cross-section and is configured to receive introduction of the discharge pressure. By the centrifugal force accompanying the rotation of rotor 16 and the internal pressure of back pressure chamber 16*b*, each vane 17 is pressed outwardly.

While rotor 16 is rotating, a distal end surface of each vane 17 is in sliding contact with the inner peripheral surface of cam ring 15, and a proximal end surface of each vane 17 is in sliding contact with an outer peripheral surface of each of ring members 18, 18. Specifically, each vane 17 is configured to be pressed up by ring members 18, 18 outwardly in the radial direction of rotor 16, so that even when the engine rotational speed is low and the centrifugal force and the pressure of back pressure chamber 16*b* are small, the distal end of each vane 17 is maintained in sliding contact with the inner peripheral surface of cam ring 15 so as to separate the pump chambers 24 liquid-tightly from each other.

Cam ring 15 is formed integrally of so-called sintered metal to have a substantially cylindrical shape, and include a pivot portion 15*a* at a predetermined position of the outer periphery of cam ring 15, wherein pivot portion 15*a* is an arc-shaped recess extending in the axial direction, and is configured to be fitted with pivot pin 19 so that the axial center forms a swing fulcrum F. Cam ring 15 also includes an arm portion 15*b* at a position opposite to the pivot portion 15*a* through the center of cam ring 15, wherein arm portion 15*b* extends in the radial direction, and is associated with a coil spring 33, wherein coil spring 33 is a biasing member having a predetermined spring constant. The arm portion 15*b* includes a pressing projection not shown at a side facing in a direction of movement (rotation), wherein the pressing projection has an arc shape and is constantly in contact with a distal end portion of coil spring 33, so that arm portion 15*b* is associated to coil spring 33.

Pivot pin 19, which serves as swing fulcrum F, is disposed outside of a substantially central portion of discharge port 22 in the circumferential direction, in the discharge region where the volumetric capacity of each of pump chambers 24 decreases, namely, on the right side of cam ring eccentric-direction line N in FIG. 4.

As shown in FIGS. 4 and 5, the inside of pump body 11 includes a spring accommodation chamber 26 disposed at a position opposite to the support hole 11*c*, wherein spring accommodation chamber 26 accommodates and holds coil spring 33, and extends substantially along the cam ring eccentric-direction line N in FIG. 4, and is adjacent to pump accommodation chamber 13. Coil spring 33 is mounted between a first end wall of spring accommodation chamber 26 and the underside of arm portion 15*b*, in a state compressed by a predetermined setting load W1.

A second end wall of spring accommodation chamber 26 is configured to serve as a restricting surface 26*a* to restrict the range of movement of cam ring 15 in the eccentric direction. Further movement of cam ring 15 in the eccentric direction is restricted by contact of restricting surface 26*a* with a second side portion of arm portion 15*b*.

Coil spring 33 is disposed outside of a substantially central portion of suction port 21 in the circumferential direction, in the suction region where the volumetric capacity of each of pump chambers 24 increases, namely, on the left side of cam ring eccentric-direction line N in FIG. 4.

In this way, cam ring 15 is constantly biased by the biasing force of coil spring 33 via the arm portion 15*b* in the direction to increase the quantity of eccentricity of cam ring 15 (in the clockwise direction in FIG. 4). In an inactive state, cam ring 15 is in a state where the second side portion of arm portion 15*b* is pressed onto the restricting surface 26*a*, and cam ring 15 is restricted in a position where the quantity of eccentricity maximized.

The outer periphery of cam ring 15 is formed with a pair of first and second seal forming portions 15*c*, 15*d* projecting and facing the first and second seal slide surfaces 11*d*, 11*e* formed in the inner peripheral wall of pump body 11. Each seal forming portion 15*c*, 15*d* includes a seal holding recess holding a corresponding one of first and second seal members 20*a*, 20*b* in sliding contact with a corresponding one of first and second seal slide surfaces 11*d*, 11*e* when cam ring 15 swings with eccentricity.

First and second seal forming portions 15*c*, 15*d* have seal surfaces having predetermined semidiameters slightly smaller than semidiameters R1, R2 of first and second seal slide surfaces 11*d*, 11*e*, respectively, such that a predetermined small clearance is formed between each seal slide surface 11*d*, 11*e* and the seal surface of the corresponding seal forming portion 15*c*, 15*d*. On the other hand, each of first and second seal members 20*a*, 20*b* is made of a material such as a fluorocarbon-based resin having a low friction property, and has a thin rectangular shape extending straight in the axial direction of cam ring 15, and is pressed onto the seal slide surface 11*d*, 11*e* by an elastic force of an elastic member, wherein the elastic member is made of rubber and disposed at a bottom portion of the holding recess, so that liquid tightness is held between the seal slide surface 11*d*, 11*e* and the seal surface of seal forming portion 15*c*, 15*d*.

In the outside region of cam ring 15, a pair of first and second control oil chambers 31, 32 are defined by pivot pin 19 and first and second seal members 20*a*, 20*b*. An in-engine oil pressure corresponding to the pump discharge pressure is introduced via a control oil introduction passage 70 to each control oil chamber 31, 32, wherein control oil introduction passage 70 is formed to branch from main oil gallery 27.

Specifically, first control oil chamber 31 is configured to receive supply of a pump discharge pressure via a first introduction passage 71 that is one of two branch passages branched from control oil introduction passage 70. On the other hand, second control oil chamber 32 is configured to receive supply of a pump discharge pressure (referred to as second discharge pressure) via a second introduction passage 72 after pressure reduction via pilot valve 40, wherein second introduction passage 72 is another branch passage branched from control oil introduction passage 70 via electromagnetic switching to valve 60 as a switching mechanism.

Application of these oil pressures to first and second pressure-receiving surfaces 15*e*, 15*f* of the outer peripheral surface of cam ring 15 facing the first and second control oil chambers 31, 32, causes first and second torques to cam ring 15 in the clockwise direction and in the counterclockwise direction, to apply a force of movement (force of swing) to cam ring 15.

Specifically, cam ring 15 receives a biasing force by the spring force of coil spring 33 in the direction to increase the quantity of change of the volumetric capacity of each pump chamber, and a further biasing force by operating oil pressure acting from first control oil chamber 31 to first pressure-receiving surface 15*e* in cam ring 15 in the direction to reduce the quantity of eccentricity against the spring force of coil spring 33. Furthermore, cam ring 15 receives a biasing force by operating oil pressure acting from second control oil chamber 32 to second pressure-receiving surface 15*f* in the direction to increase the quantity of eccentricity in cooperation with the spring force of coil spring 33.

The second pressure-receiving surface 15*f* is set to have a larger area than first pressure-receiving surface 15*e*, so that when the same oil pressure acts on both, cam ring 15 is biased totally in the direction to increase the quantity of eccentricity of cam ring 15 (in the clockwise direction in FIG. 4).

The difference between the first and second torques (biasing forces) based on the difference in area between first pressure-receiving surface 15*e* and second pressure-receiving surface 15*f* can be expressed by vectors as shown in FIG. 4. This force can be decomposed into a component of a first vector B1 (semidiameter R1) in a direction to first seal member 20*a* (endpoint) from swing fulcrum F of cam ring 15 as a start point, and a component of a second vector B2 (semidiameter R2) in a direction to second seal member 20*b* (endpoint) from swing fulcrum F, where swing fulcrum F is the axial center of pivot pin 19. The second vector B2 is set to be larger than first vector B1.

By the configuration described above, in oil pump 10, when the biasing force (vector) based on the internal pressures of control oil chambers 31, 32 is smaller than setting load W1 of coil spring 33, cam ring 15 is put in a maximally eccentric state shown in FIG. 4. On the other hand, when the biasing force (vector) based on the internal pressure of first control oil chamber 31 exceeds the setting load W1 of coil spring 33 as the discharge pressure rises, cam ring 15 is moved in the coaxial direction (in the counterclockwise in FIG. 4) depending on the discharge pressure.

As shown in FIGS. 1 and 4, pilot valve 40 includes: a valve body 41 formed integrally with a first side portion of cover member 12, and having a cylindrical shape, and including a valve accommodation hole 41*a* having an open lower end side in its axial direction; a plug 42 closing the lower end opening of valve body 41; a spool valve element 43 accommodated radially inside of valve body 41 and configured to slide in the axial direction, and employed for control of supply and drain of oil pressure to and from second control oil chamber 32 in accordance with a slide position of spool valve element 43; and a valve spring 44 disposed between plug 42 and spool valve element 43 radially inside of a lower end portion of valve body 41, and mounted in a state compressed by a predetermined setting load W2, and thereby configured to constantly bias the spool valve element 43 toward an upper end side of valve body 41.

The valve accommodation hole 41*a* accommodates spool valve element 43 inside, and includes an upper end wall opened and formed with an introduction port 51 that is connected to electromagnetic switching valve 60 via first branch passage 72*a* branched from a downstream side of second introduction passage 72. Plug 42 is press-fitted and fixed in the lower end opening part of valve accommodation hole 41*a*.

Moreover, the peripheral wall of valve accommodation hole 41*a* includes an intermediate portion in the axial direction, which is opened and formed with a supply-drain port 52 having a first end side connected to second control oil chamber 32 and a second end side connected constantly to a relay chamber 57 described below, wherein supply-drain port 52 is employed for supply and drain of oil pressure with respect to second control oil chamber 32. The lower end side of valve accommodation hole 41*a* in the axial direction is opened and formed with a first drain port 53, wherein first drain port 53 includes a first end side connected to a suction side, and is configured to drain oil pressure from second control oil chamber 32 via the relay chamber 57 by switching of communication with relay chamber 57.

The peripheral wall of the lower end side of valve body 41 is opened and formed with a second drain port 54, wherein second drain port 54 overlaps with a back pressure chamber 58 described below, and is configured to communicate with the suction side, similar to first drain port 53.

Supply-drain port 52 is configured to constantly communicate with second control oil chamber 32 via a communication passage 59 that is formed inside of the lower part of valve body 41.

Furthermore, valve body 41 is formed with a communication port 55 between introduction port 51 and first drain port 53, wherein communication port 55 extends in a radial direction, and is configured to allow communication between relay chamber 57 and a second branch passage 72*b* when spool valve element 43 is in an upper position (see FIG. 7A) in FIG. 4, wherein second branch passage 72*b* is branched from a further downstream end of second introduction passage 72 with respect to first branch passage 72*a*.

Spool valve element 43 includes a first land portion 43*a* including an upper end surface formed as a pressure-receiving surface 56 configured to receive a discharge pressure introduced through the introduction port 51, wherein first land portion 43*a* and a second land portion 43*b* are provided at an upper end portion and a lower end portion respectively in the axial direction. Spool valve element 43 includes a small-diameter shaft portion 43*c* between land portions 43*a*, 43*b*, and is formed with relay chamber 57 radially outside of small-diameter shaft portion 43*c*, wherein relay chamber 57 has a cylindrical shape, and is configured to connect the supply-drain port 52 to introduction port 51 (communication port 55) or to first drain port 53, depending on the axial position of spool valve element 43.

Back pressure chamber 58 is formed between second land portion 43*b* and plug 42, and is employed for draining oil that leaks from relay chamber 57 via the outer peripheral side (infinitesimal clearance) of second land portion 43*b*.

By the configuration described above, when the discharge pressure acting from introduction port 51 to pressure-receiving surface 56 is lower than or equal to a predetermined pressure (operating oil pressure of spool valve element 43 described below), spool valve element 43 of pilot valve 40 is positioned in a first region of valve accommodation hole 41*a* by the biasing force of valve spring 44 based on the setting load W2, wherein the first region is a predetermined region of the upper end side of valve accommodation hole 41*a* (see FIGS. 4 and 7A).

The condition that spool valve element 43 is positioned in the first region, allows communication between second branch passage 72*b* and relay chamber 57 via communication port 55, and prevents communication between first drain port 53 and relay chamber 57 by second land portion 43*b*, and allows communication between second control oil chamber 32 and relay chamber 57 via supply-drain port 52, simultaneously.

Figure 8A:
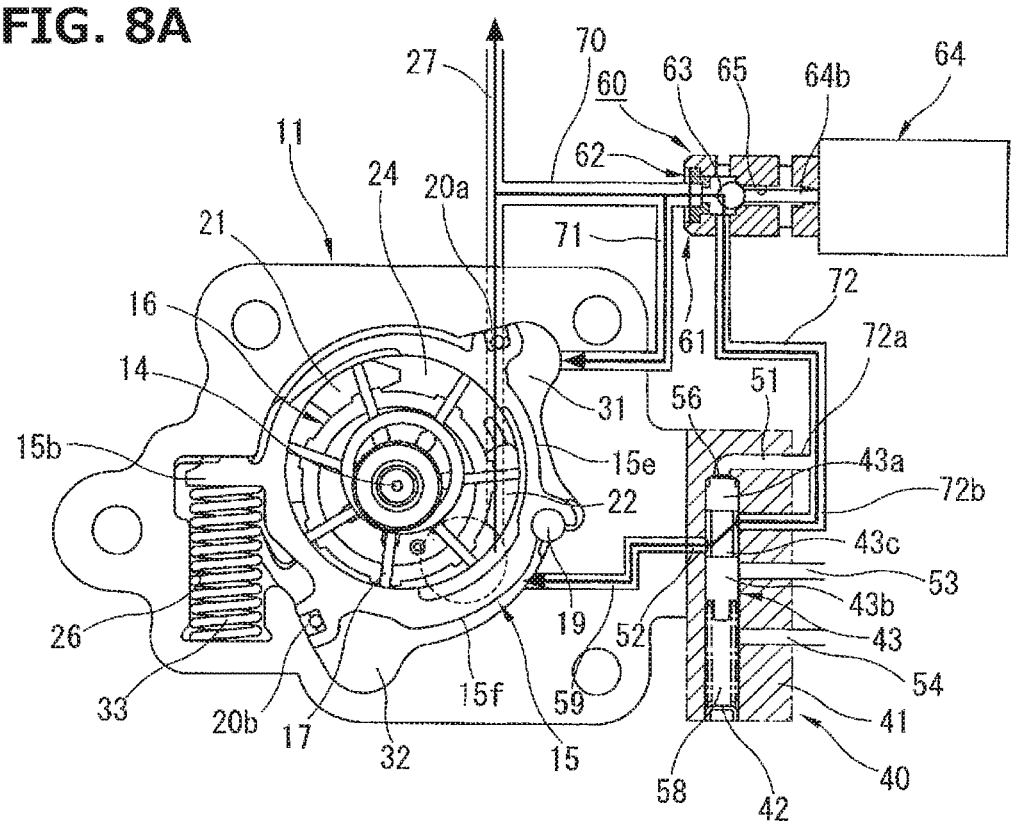
FIGS. 8A and 8B are oil pressure circuit diagrams of the variable displacement type oil pump according to the present embodiment, where
Figure 8B:
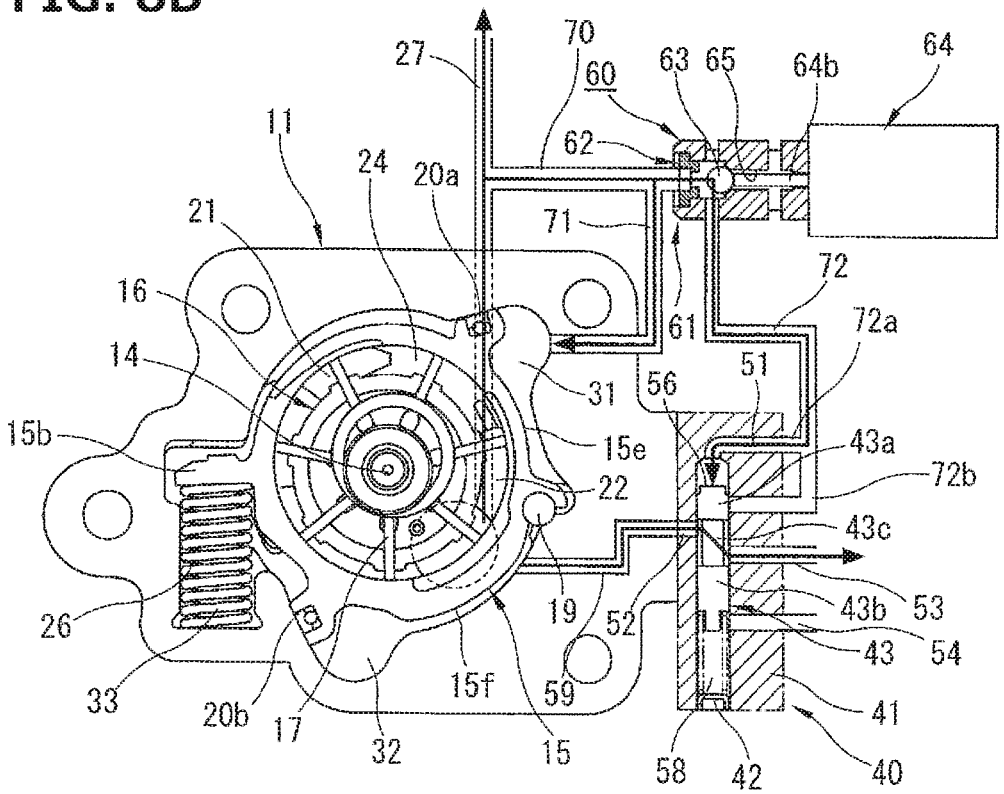

As the discharge pressure acting on pressure-receiving surface 56 exceeds the predetermined pressure, spool valve element 43 moves from the first region toward the lower side of valve accommodation hole 41*a* against the spring force of valve spring 44, and gets positioned in a second region that is a predetermined region in the lower side of valve accommodation hole 41*a* (see FIG. 8B). The condition that spool valve element 43 is positioned in the second region, maintains communication between second control oil chamber 32 and relay chamber 57 via supply-drain port 52, and prevents communication between communication port 55 and relay chamber 57 by first land portion 43*a*, and allows communication between relay chamber 57 and the oil pan or the like via first drain port 53, simultaneously.

Figure 9:
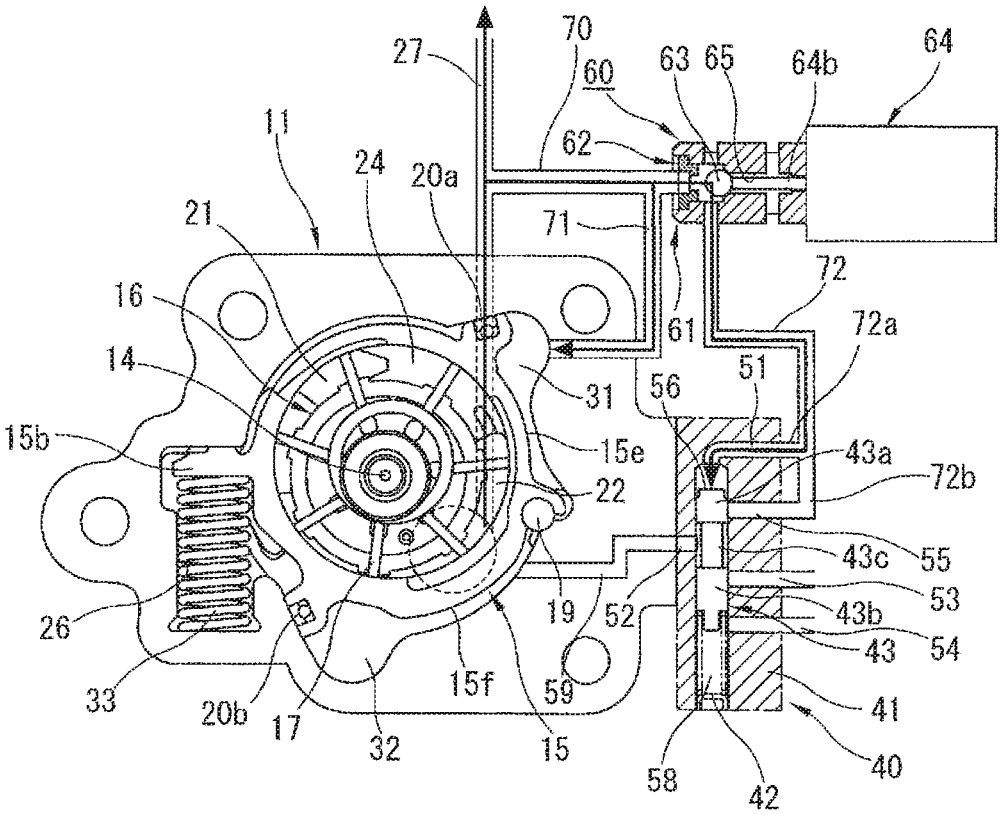
FIG. 9 is an oil pressure circuit diagram of the variable displacement type oil pump according to the present embodiment, showing a state of the pump at a point C-A in FIG. 6.

As the discharge pressure acting on the pressure-receiving surface 56 decreases slightly as compared to the condition that the discharge pressure is maintained higher than or equal to the predetermined pressure, spool valve element 43 gets positioned in a third region slightly above the second region by the spring force of valve spring 44. As shown in FIG. 9, this condition causes the first land portion 43*a* of spool valve element 43 to close the communication port 55 so as to prevent its communication with relay chamber 57, and causes the second land portion 43*b* to close the first drain port 53 so as to prevent its communication with relay chamber 57. This puts the second control oil chamber 32, communication passage 59, supply-drain port 52, and communication port 55 in a state of closed circuit.

As shown in FIG. 4, electromagnetic switching valve 60 generally includes: a valve body 61 disposed between control oil introduction passage 70 and second introduction passage 72, and having a substantially cylindrical shape inside which an oil passage 65 extends through in the axial direction; a valve element accommodation portion 66 formed in a first end portion of valve body 61 by extension of the diameter of oil passage 65; a seat member 62 press-fitted and fixed in an outer end portion of valve element accommodation portion 66, and including a central portion including an introduction port 67 as an upstream end opening connected to an upstream side passage of second introduction passage 72; a ball valve element 63 configured to be on and off a valve seat 62*a* formed at an inner end opening edge of seat member 62, and configured to be employed for opening and closing of introduction port 67; and a solenoid 64 provided at a second end portion (right end portion in FIG. 4) of valve body 61.

Valve body 61 is formed with a valve seat 66*a* similar to valve seat 62*a* of seat member 62, wherein valve seat 66*a* is formed at an inner end opening edge of valve element accommodation portion 66, wherein valve element accommodation portion 66 is formed radially inside of the first end side of valve body 61, and accommodates the ball valve element 63. The peripheral wall of valve body 61 is formed with a supply-drain port 68 and a plurality of drain ports 69, wherein supply-drain port 68 is formed in a first end side of the peripheral wall radially outside of valve element accommodation portion 66, and extends through in a radial direction, and serves as a downstream side opening portion connected to an upstream side of second introduction passage 72, and is employed for supply and drain of oil pressure to and from pilot valve 40, and wherein each drain port 69 is formed in a second end side of the peripheral wall radially outside of oil passage 65, and extends through in a radial direction, and is connected to a drain side including the oil pan.

Solenoid 64 includes a casing 64*a* and a rod 64*b*, wherein casing 64*a* houses a coil not shown, and rod 64*b* is fixed to an armature arranged radially inside of the coil. Solenoid 64 is configured to move the armature and rod 64*b* in the leftward direction in FIG. 4 by an electromagnetic force generated by energization of the coil. Solenoid 64 is applied with an excitation current from an on-board ECU not shown based on a state of operation of the engine which is sensed or calculated from predetermined parameters such as oil temperature, water temperature, and engine speed of the internal combustion engine.

Accordingly, when solenoid 64 is energized, rod 64*b* moves forward so that ball valve element 63 disposed at the distal end portion of rod 64*b* is pressed onto valve seat 62*a* of seat member 62, thereby preventing communication between introduction port 67 and supply-drain port 68, and allowing communication between supply-drain port 68 and drain port 69 through the oil passage 65. On the other hand, when solenoid 64 is de-energized, ball valve element 63 is moved backward by the discharge pressure introduced via introduction port 67 so that ball valve element 63 is pressed onto valve seat 66*a* of valve body 61, thereby allowing communication between introduction port 67 and supply-drain port 68, and preventing communication between supply-drain port 68 and drain port 69.

<Actions of Oil Pump>

The following describes actions of oil pump 10 according to the present embodiment with reference to FIGS. 7 to 9.

Figure 6:
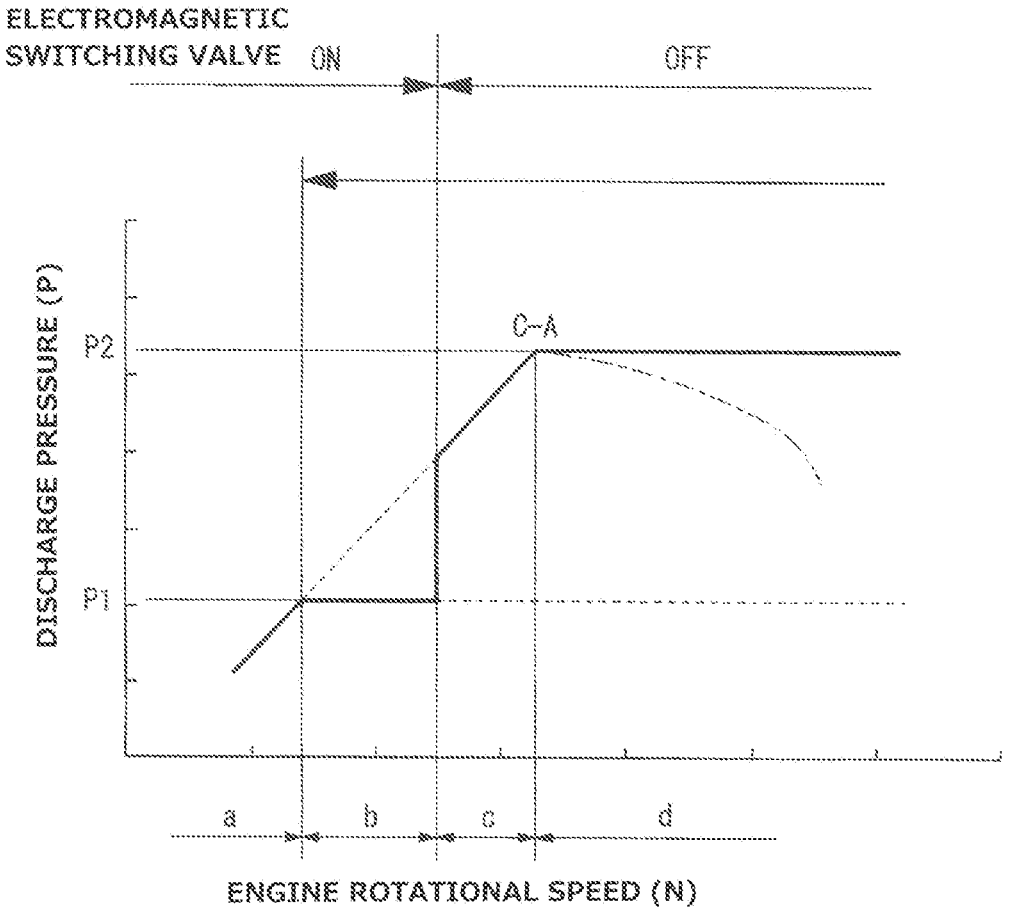
FIG. 6 is a graph showing characteristics of oil pressure of the variable displacement type oil pump according to the present embodiment.

First, the following describes a required oil pressure of the internal combustion engine which is a reference for control of the discharge pressure of oil pump 10, with reference to FIG. 6, in advance to description of actions of oil pump 10. In FIG. 6, P1 represents a first engine request oil pressure corresponding to a request oil pressure of a device such as a valve timing control device for fuel efficiency improvement when such a device is employed, and P2 represents a second engine request oil pressure which is required for lubrication of bearing parts of the crankshaft when the engine is rotating at high speed. It is ideal to change the discharge pressure (required oil pressure) P depending on engine rotational speed N of the internal combustion engine, in accordance with request oil pressures P1, P2.

In FIG. 6, a solid line represents a characteristic of oil pressure of oil pump 10 according to the present invention, and a long-dashed short-dashed line represents a characteristic of oil pressure of the conventional oil pump from a point C-A where discharge pressure P2 is reached.

Figure 7A:
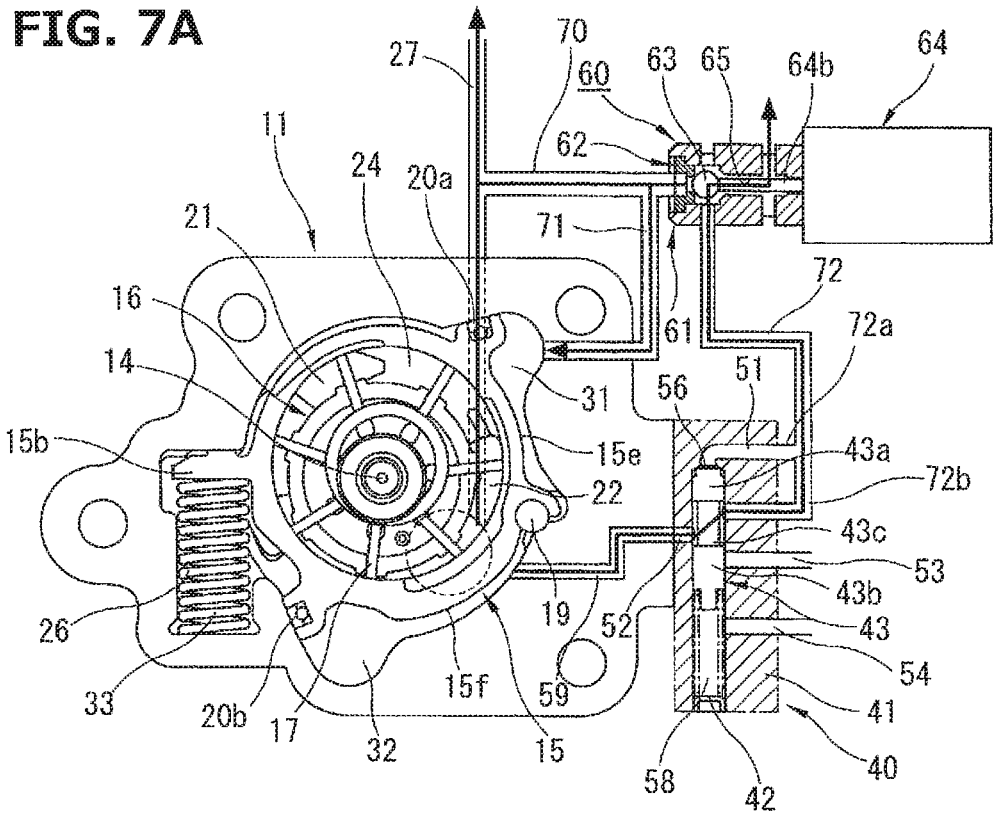
FIGS. 7A and 7B are oil pressure circuit diagrams of the variable displacement type oil pump according to the present embodiment, where

In oil pump 10 according to the present embodiment, in a section "a" in FIG. 6 corresponding to a region of rotation from engine start to low-speed region, solenoid 64 is energized with an excitation current so as to prevent communication between introduction port 67 and supply-drain port 68, and allow communication between supply-drain port 68 and drain port 69, as shown in FIG. 7A. This prevents the discharge pressure P from being introduced into second control oil chamber 32 (pilot valve 40) so that spool valve element 43 of pilot valve 40 is positioned in the first region.

Accordingly, as shown by an arrow in the figure, oil in second control oil chamber 32 is drained through communication passage 59, supply-drain port 52, relay chamber 57, second branch passage 72*b*, and oil passage 65, and then through drain port 69 of electromagnetic switching valve 60, while discharge pressure P is supplied only to first control oil chamber 31.

In this engine rotation region, discharge pressure P is lower than an operating oil pressure with which cam ring 15 swings, so that cam ring 15 is maintained in the state of maximum eccentricity, and discharge pressure P has a characteristic of increasing substantially in proportion to engine rotational speed N.

Figure 7B:
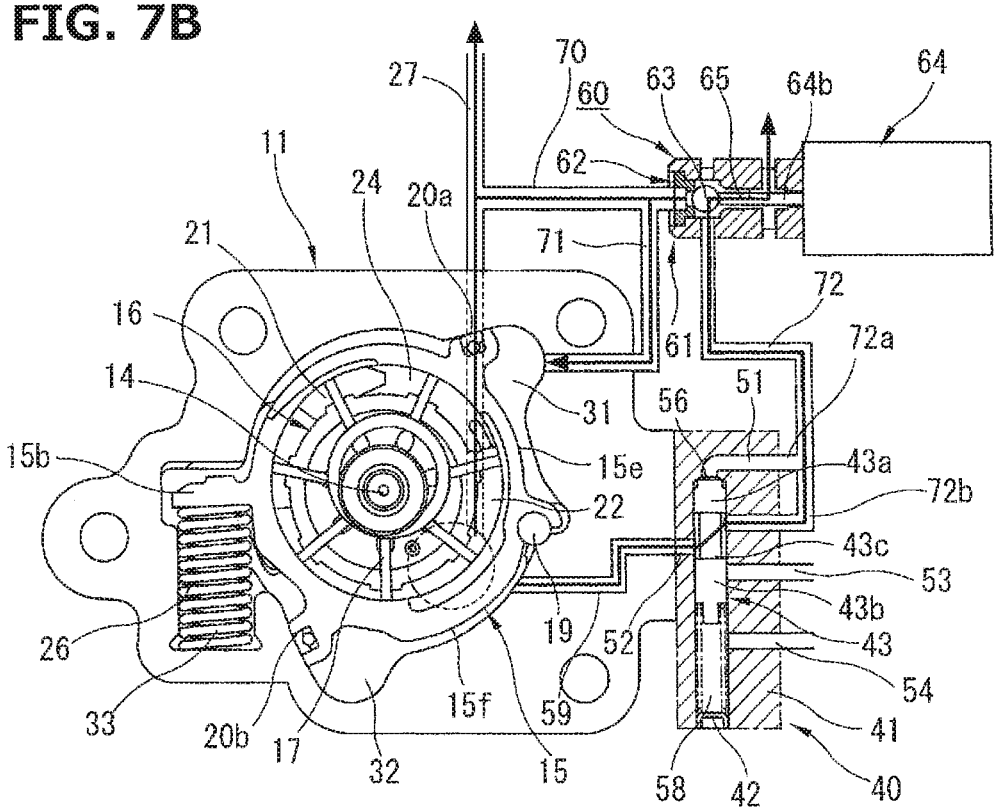

Thereafter, as engine rotational speed N rises and discharge pressure P reaches the operating oil pressure with which cam ring 15 swings, solenoid 64 is maintained energized so as to continue to supply discharge pressure P only to first control oil chamber 31, as shown in FIG. 7B. This causes the biasing force based on the internal pressure of first control oil chamber 31 to exceed the biasing force W1 of coil spring 33, and thereby causes cam ring 15 to move in the coaxial direction. This reduces the discharge pressure P, and a quantity of increase of discharge pressure P becomes smaller (in the section "b" in FIG. 6) than when cam ring 15 is in the state of maximum eccentricity.

Thereafter, as engine rotational speed N further rises and the engine operating state requires second engine request oil pressure P2, solenoid 64 is de-energized so as to allow communication between introduction port 67 and supply-drain port 68, and prevent communication between supply-drain port 68 and drain port 69, as shown in FIG. 8A. This causes the discharge pressure P introduced through second introduction passage 72 to be introduced to pressure-receiving surface 56 of pilot valve 40 via the first branch passage 72*a*. In this situation, the discharge pressure P has not yet reached the operating oil pressure with which spool valve element 43 operates, so that spool valve element 43 of pilot valve 40 is maintained in the first region, and communication among communication port 55, relay chamber 57, and supply-drain port 52 is allowed, and first drain port 53 is closed by second land portion 43*b*, and the second discharge pressure is supplied to second control oil chamber 32.

Accordingly, a resultant force of the biasing force W1 of coil spring 33 and the biasing force based on the internal pressure of second control oil chamber 32 becomes a biasing force to cam ring 15 in the eccentric direction, wherein this biasing force exceeds the biasing force based on the internal pressure of first control oil chamber 31 in the coaxial direction, so that cam ring 15 is moved back in the direction to increase the quantity of eccentricity of cam ring 15, and the quantity of increase of discharge pressure P increases again (in the section "c" in FIG. 6).

Thereafter, as discharge pressure P rises with the characteristic of increase described above, and reaches the operating oil pressure of spool valve element 43, spool valve element 43 of pilot valve 40 receives the discharge pressure P acting from introduction port 51 to pressure-receiving surface 56, and moves in the downward direction (toward the plug 42) against the biasing force W2 of valve spring 44, and the position of spool valve element 43 shifts from the first region to the second region, as shown in FIG. 8B. This causes the first land portion 43*a* to close the opening of communication port 55 at the valve accommodation hole 41*a*, and allows communication between supply-drain port 52 and first drain port 53 via relay chamber 57, so that oil in second control oil chamber 32 is drained and discharge pressure P is supplied only to first control oil chamber 31. This causes the biasing force based on the internal pressure of first control oil chamber 31 in the coaxial direction to exceed the biasing force in the eccentric direction based on the resultant force of the biasing force W1 of coil spring 33 and the biasing force based on the internal pressure of second control oil chamber 32, and thereby causes the cam ring 15 to move in the coaxial direction, and reduces the discharge pressure P.

The reduction of discharge pressure P causes the oil pressure (discharge pressure P) acting on the pressure-receiving surface 56 of spool valve element 43 to be lower than the operating oil pressure of spool valve element 43, so that the biasing force W2 of valve spring 44 exceeds the biasing force based on discharge pressure P, and spool valve element 43 moves toward introduction port 51, as shown in FIG. 8A. This allows communication between communication port 55 and supply-drain port 52 of pilot valve 40, and thereby causes the second discharge pressure to be supplied to second control oil chamber 32 again. This moves the cam ring 15 back in the eccentric direction, and increases the discharge pressure P again.

Thereafter, as the increase of discharge pressure P causes the oil pressure acting on the pressure-receiving surface 56 of spool valve element 43 to exceed the operating oil pressure of spool valve element 43, spool valve element 43 moves again into the second region against the biasing force W2 of valve spring 44, as shown in FIG. 8B. This causes the oil in second control oil chamber 32 to be drained, and causes the discharge pressure P to be supplied only to first control oil chamber 31, as described above.

As a result, the biasing force based on the internal pressure of first control oil chamber 31 in the coaxial direction exceeds the biasing force in the eccentric direction which is the resultant force of the biasing force W1 of coil spring 33 and the biasing force based on the internal pressure of second control oil chamber 32, so that cam ring 15 moves in the coaxial direction, and discharge pressure P decreases again.

In this way, oil pump 10 according to the present embodiment is configured to perform an adjustment to maintain the discharge pressure P at the operating oil pressure of spool valve element 43 by continuing to alternately switch between communication between communication port 55 and supply-drain port 52 connected to second control oil chamber 32, and communication between first drain port 53 and supply-drain port 52 by spool valve element 43 of pilot valve 40. Since this pressure regulation is implemented by switching of supply-drain port 52 by pilot valve 40, it is not influenced by the spring constant of coil spring 33. Moreover, since the pressure regulation is performed within a significantly small range of stroke of spool valve element 43 related to the switching of supply-drain port 52, it is not influenced by the spring constant of valve spring 44. As a result, in the section "d", as engine rotational speed N rises, the discharge pressure P of oil pump 10 does not increase in proportion but has a substantially flat characteristic.

As described above, oil pump 10 according to the present embodiment can maintain the discharge pressure P at the predetermined high pressure P2 by the pressure regulation control of pilot valve 40, in the engine rotation region (in the section "d" in FIG. 6) where it is requested to maintain at least the predetermined high pressure (spool valve operating oil pressure) equal to the second engine request oil pressure P2.

Specifically, in case of oil pump 10 according to the present embodiment, when discharge pressure P exceeds the predetermined pressure that is the operating oil pressure of spool valve element 43, after the condition that discharge pressure P is higher than the operating oil pressure of cam ring 15, and lower than or equal to the operating oil pressure of spool valve element 43, spool valve element 43 moves from the first region to the second region so as to reduce the quantity of eccentricity of cam ring 15, and discharge pressure P becomes below the spool valve operating oil pressure again, and spool valve element 43 moves back to the first region. Thus, switching of communication via supply-drain port 52 by spool valve element 43 continues to be repeatedly performed, so that discharge pressure P can be maintained at the operating oil pressure of spool valve element 43, and the predetermined high pressure characteristic P2 can be maintained.

Moreover, as described above, in oil pump 10 according to the present embodiment, immediately before the slide position of spool valve element 43 of pilot valve 40 shifts from the first region to the second region, and oil is drained from second control oil chamber 32 through relay chamber 57 to first drain port 53, the first land portion 43*a* of spool valve element 43 closes the opening of communication port 55 at valve accommodation hole 41*a*, and the second land portion 43*b* closes the opening end of first drain port 53 simultaneously, thereby putting the second control oil chamber 32, communication passage 59, and supply-drain port 52 temporarily in the state of closed circuit, as shown in FIG. 9.

Accordingly, the condition that second control oil chamber 32 is filled with oil is maintained, so that cam ring 15 is maintained stably in the position in the direction to increase the quantity of eccentricity by the resultant force of the spring force of coil spring 33 and the operating oil pressure (second vector B2) acting on the second pressure-receiving surface 15*f* of second control oil chamber 32 which has a larger area than the first pressure-receiving surface 15*e* of first control oil chamber 31.

In the conventional oil pump described above, when engine rotational speed N rises, many bubbles occur in oil and the bubbles collapse in pump chambers 24 in the discharge region, so that the internal pressures of pump chambers 24 get out of balance, and the behavior of cam ring 15 becomes unstable. As a result, in the state of high pressure characteristic P2, it is possible that discharge pressure P falls and a desired discharge pressure cannot be obtained, as shown by the long-dashed short-dashed line in FIG. 6.

In contrast, according to the present embodiment, even if bubbles in pump chambers 24 collapse to bring the internal pressures of pump chambers 24 in the discharge region out of balance in the high engine speed region, cam ring 15 is maintained in the position to which cam ring 15 is moved in the direction to increase the quantity of eccentricity, because the second pressure-receiving surface 15*f* is formed to have a larger area than the first pressure-receiving surface 15*e*, and the second vector B2 acting on the side of second control oil chamber 32 is larger than the first vector B1 acting on the side of first control oil chamber 31, as described above. This serves to suppress the behavior of cam ring 15 from becoming unstable, and thereby maintain the high pressure characteristic P2 flat.

Second Embodiment

Figure 10:
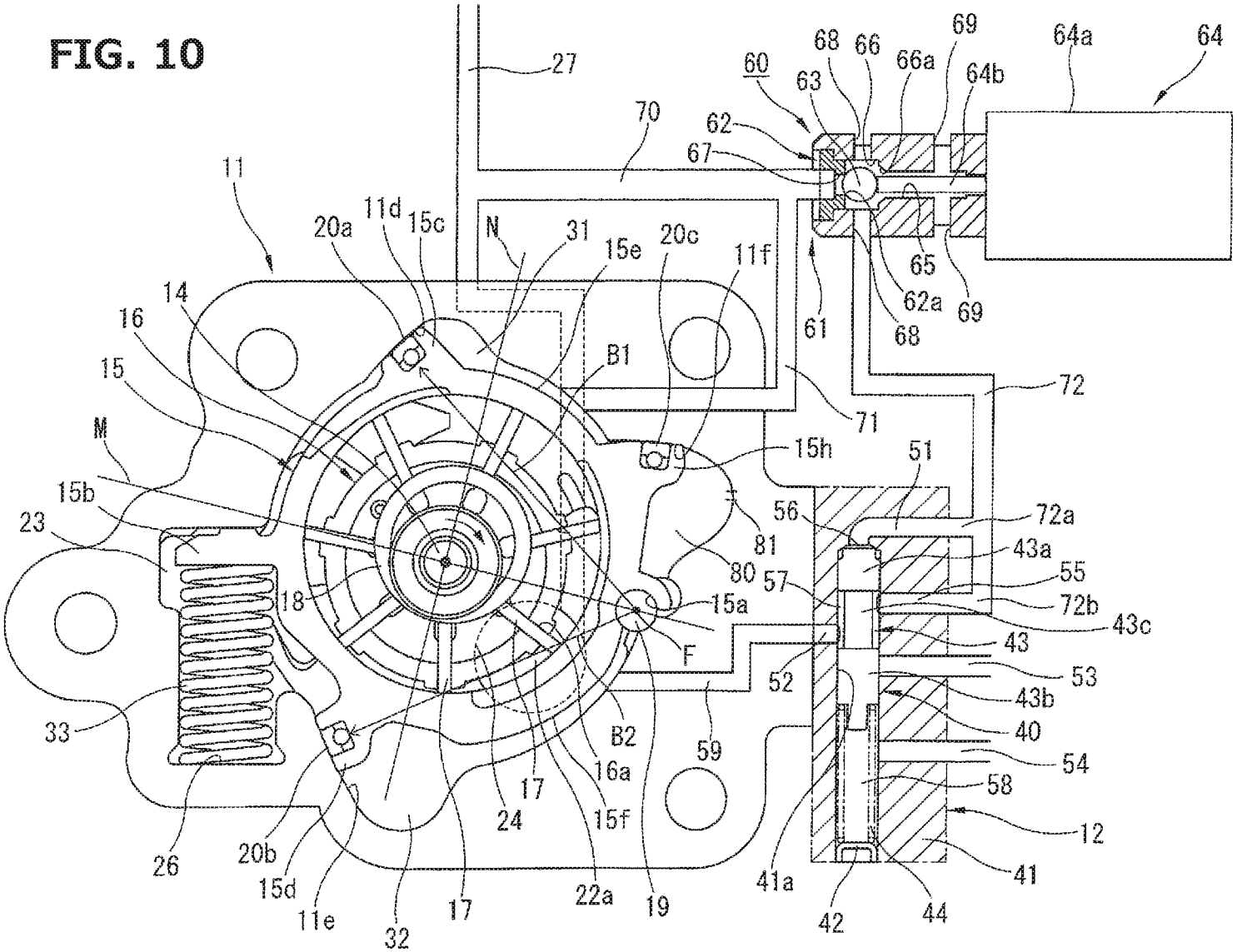
FIG. 10 is an oil pressure circuit diagram of a variable displacement type oil pump according to a second embodiment of the present embodiment.

FIG. 10 shows a variable displacement type oil pump according to a second embodiment, which has basic configuration similar to that of the first embodiment, but differs in that a third control oil chamber 80 is formed between first control oil chamber 31 and second control oil chamber 32.

Specifically, first seal slide surface 11*d* of pump body 11 is moved and arranged toward arm portion 15*b* of cam ring 15 in the circumferential direction, and the whole of first control oil chamber 31 is moved in the same direction, and third control oil chamber 80 is formed between first control oil chamber 31 and support hole 11*c* of pump body 11 supporting the pivot pin 19.

More specifically, the outer periphery of cam ring 15 is formed with a third seal forming portion 15*h* projecting and facing a third seal slide surface 11*f* of the inner peripheral wall of pump body 11. A third seal member 20*c* is accommodated and held in a seal holding recess formed in the outer surface of third seal forming portion 15*h*, wherein third seal member 20*c* is in sliding contact with third seal slide surface 11*f* when cam ring 15 swings with eccentricity.

Third seal member 20*c* is similar to first and second seal members 20*a*, 20*b*, and is made of a material such as a fluorocarbon-based resin having a low friction property, and has a thin rectangular shape extending straight, and is pressed onto third seal slide surface 11*f* by an elastic force of an elastic member, wherein the elastic member is made of rubber and disposed at a bottom portion of the holding recess, so that liquid tightness is held between third seal member 20*c* and third seal slide surface 11*f*.

Third control oil chamber 80 is defined by pivot pin 19 and third seal member 20*c*, and is configured to communicate with the low pressure part such as the inside of the oil pan via a drain port 81.

The provision of third control oil chamber 80 between pivot pin 19 and first control oil chamber 31 serves to set the first vector B1 (semidiameter R1) larger than in the first embodiment, even if the area of first pressure-receiving surface 15*e* of cam ring 15 facing the first control oil chamber 31 is equal to that of the first embodiment. Namely, first and second control oil chambers 31, 32 may be arbitrarily arranged around the outer periphery of cam ring 15, if the second vector B2 serving for the force of swing of cam ring 15 is larger than the first vector B1.

The operations of pilot valve 40 and electromagnetic switching valve 60 are similar to those of the first embodiment, wherein it is possible to obtain a two-stage control including a high pressure characteristic and a low pressure characteristic of discharge pressure by control of the swing position of cam ring 15 by control of valves 40, 60, as in the first embodiment.

Oil leaked from first control oil chamber 31 and second control oil chamber 32 via third seal member 20*c* and pivot pin 19 and others is collected in third control oil chamber 80, and can be drained to the outside via drain port 81. This allows to precisely control the quantity of oil supplied in first control oil chamber 31 and second control oil chamber 32. This serves to further stabilize the control of the swing position of cam ring 15.

Third Embodiment

Figure 11:
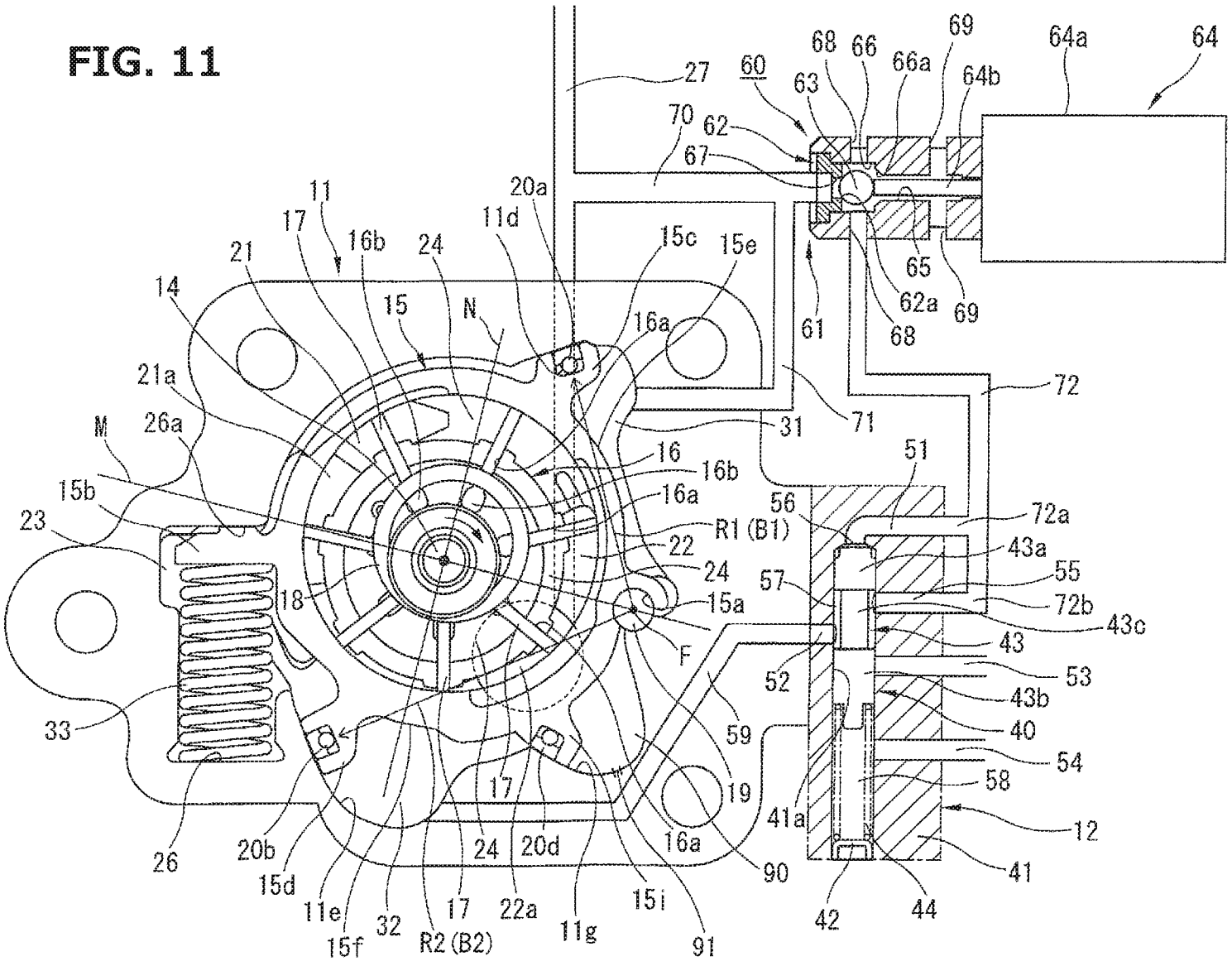
FIG. 11 is an oil pressure circuit diagram of a variable displacement type oil pump according to a third embodiment of the present embodiment.

FIG. 11 shows a third embodiment where third control oil chamber 90 is formed in a modified position. First control oil chamber 31 is formed in the same position as in the first embodiment, and third control oil chamber 90 is formed between second control oil chamber 32 and support hole 11*c* of pump body 11 supporting the pivot pin 19.

Specifically, the outer periphery of cam ring 15 is formed with a third seal forming portion 15*i* projecting and facing a third seal slide surface 11*g* of the inner peripheral wall of pump body 11. A third seal member 20*d* is accommodated and held in a seal holding recess formed in the outer surface of third seal forming portion 15*i*, wherein third seal member 20*d* is in sliding contact with third seal slide surface 11*g* when cam ring 15 swings with eccentricity.

Third seal member 20*d* is similar to first and second seal members 20*a*, 20*b*, and is made of a material such as a fluorocarbon-based resin having a low friction property, and has a thin rectangular shape extending straight, and is pressed onto third seal slide surface 11*g* by an elastic force of an elastic member, wherein the elastic member is made of rubber and disposed at a bottom portion of the holding recess, so that third control oil chamber 90 is liquid-tightly separated between pivot pin 19 and third seal slide surface 11*g*, and is configured to communicate with the low pressure part such as the inside of the oil pan via a drain port 91.

In spite of the provision of third control oil chamber 90 between pivot pin 19 and second control oil chamber 32, the second vector B2 of the semidiameter R2 from pivot pin 19 to second seal slide surface 11*e* is larger than the first vector B1 of the semidiameter R1 from pivot pin 19 to first seal slide surface 11*d* such that a torque vector (second torque) based on the oil pressure of second control oil chamber 32 is larger than a torque vector (first torque) based on the oil pressure of first control oil chamber 31, and the position of cam ring 15 can be stably held in the state of high pressure characteristic P2.

The operations of pilot valve 40 and electromagnetic switching valve 60 are similar to those of the first embodiment, wherein it is possible to obtain a two-stage control including a high pressure characteristic and a low pressure characteristic of discharge pressure by control of the swing position of cam ring 15 by control of valves 40, 60, as in the first embodiment.

Oil leaked from first control oil chamber 31 and second control oil chamber 32 via third seal member 20*d* and pivot pin 19 and others is collected in third control oil chamber 90, and can be drained to the outside via drain port 91. This allows to precisely control the quantity of oil supplied in first control oil chamber 31 and second control oil chamber 32. This serves to further stabilize the control of the swing position of cam ring 15.

The present invention is not limited to the configurations according to the embodiments described above. For example, the first and second engine request oil pressures P1, P2, the operating oil pressure of cam ring 15, and the operating oil pressure of spool valve element 43 may be changed arbitrarily depending on specifications of the internal combustion engine and valve timing device and others of the vehicle where oil pump 10 is mounted.

The embodiments are exemplified such that the quantity of discharge can be varied by swing of cam ring 15. However, variation of the quantity of discharge is not limited to the swing means described above, but may be implemented by moving the cam ring 15 straight in a radial direction. In other words, the form of movement of cam ring 15 is unlimited, if the configuration is capable of varying the quantity of discharge (the configuration is capable of varying the quantity of change of the volumetric capacity of pump chamber 24).

The embodiments are exemplified as the variable displacement type oil pump. For example, the present invention may be applied to a trochoid type pump. In such a case, an outer rotor forming an external gear corresponds to the swing member. The varying mechanism is configured by arranging the outer rotor to move with eccentricity similar to cam ring 15, and arranging control oil chambers and a spring radially outside of the outer rotor.

The invention claimed is:

1. A variable displacement oil pump comprising:

a pump forming member accommodated in a pump housing, and structured to be rotationally driven so as to change a volumetric capacity of each of a plurality of pump chambers, and suck working oil through a suction part, and discharge working oil through a discharge part;

a swing member accommodated in the pump housing, and structured to accommodate the pump forming member inside of the swing member, and swing about a swing fulcrum so as to vary a quantity of change of the volumetric capacity of each of the plurality of pump chambers opened to the discharge part, wherein the swing fulcrum is set at an outer periphery of the swing member;

a biasing member accommodated in the pump housing, and mounted with application of a setting load so as to bias the swing member in a direction to increase the quantity of change of the volumetric capacity of each of the plurality of pump chambers, the biasing member including a single spring;

a first control oil chamber formed in the pump housing between an inner peripheral surface of the pump housing and a first pressure-receiving surface of the swing member, and structured to be supplied with the discharged working oil from the discharge part such that the supplied discharged working oil in the first control oil chamber applies a first torque to the swing member via the first pressure-receiving surface in a direction to reduce the quantity of change of the volumetric capacity of each of the plurality of pump chambers;

a second control oil chamber formed in the pump housing between the inner peripheral surface of the pump housing and a second pressure-receiving surface of the swing member, and structured to be supplied with the discharged working oil via a switching mechanism from the discharge part such that the supplied discharged working oil in the second control oil chamber applies a second torque to the swing member via the second pressure-receiving surface in a direction to increase the quantity of change of the volumetric capacity of each of the plurality of pump chambers, wherein the second pressure-receiving surface of the swing member has a larger area than the first pressure-receiving surface of the swing member; and the switching mechanism structured to switch between supply of the discharged working oil from the discharge part to the second control oil chamber and drain of the supplied discharged working oil from the second control oil chamber.

2. The variable displacement oil pump as claimed in claim 1, wherein:

a second vector is larger than a first vector;

the first vector has a point of origin at the swing fulcrum, and is associated with the first torque; and the second vector has a point of origin at the swing fulcrum, and is associated with the second torque.

3. The variable displacement oil pump as claimed in claim 2, wherein:

the swing fulcrum is disposed in a discharge region in which the discharge part is formed and the volumetric capacity of each of the plurality of pump chambers decreases; and the biasing member is disposed in a suction region in which the suction part is formed and the volumetric capacity of each of the plurality of pump chambers increases.

4. The variable displacement oil pump as claimed in claim 3, wherein:

the first vector has an endpoint in the discharge region; and the second vector has an endpoint in the suction region.

5. The variable displacement oil pump as claimed in claim 3, wherein:

the first vector has an endpoint in the suction region; and the second vector has an endpoint in the suction region.

6. The variable displacement oil pump as claimed in claim 1, further comprising a control mechanism disposed between the second control oil chamber and the switching mechanism, and structured to:

set a state in which working oil having a pressure obtained by pressure reduction from a discharge pressure outputted from the discharge part is introduced into the second control oil chamber;

set a state in which working oil is drained from the second control oil chamber; and drain working oil from the second control oil chamber for pressure reduction adjustment for the second control oil chamber as the discharge pressure increases, in a state in which working oil is introduced into the first control oil chamber.

7. The variable displacement oil pump as claimed in claim 6, wherein the control mechanism is structured to set a state preventing introduction and drain of working oil to and from the second control oil chamber temporarily when switching from the state in which working oil is introduced into the second control oil chamber to the state in which working oil is drained from the second control oil chamber.

8. The variable displacement oil pump as claimed in claim 1, further comprising a third control oil chamber disposed between the first control oil chamber and the second control oil chamber sandwiching the swing fulcrum in a circumferential direction, and disposed adjacent to the swing fulcrum and the first control oil chamber, and including a drain port via which working oil is allowed to be drained to an outside of the third control oil chamber.

9. The variable displacement oil pump as claimed in claim 1, further comprising a third control oil chamber disposed between the first control oil chamber and the second control oil chamber sandwiching the swing fulcrum in a circumferential direction, and disposed adjacent to the swing fulcrum and the second control oil chamber, and including a drain port via which working oil is allowed to be drained to an outside of the third control oil chamber.

10. A variable displacement oil pump for an internal combustion engine, comprising:

a pump housing including a pump accommodation chamber;

a swing member accommodated in the pump accommodation chamber, and structured to swing about a swing fulcrum, wherein the swing fulcrum is set at an inner periphery of the pump housing defining the pump accommodation chamber;

a pump forming member accommodated inside the swing member, including a rotational center eccentric from a center of an inside diameter of the swing member, defining a plurality of pump chambers between the pump forming member and the swing member radially outside the rotational center, and configured to suck working oil via a suction part formed in a suction region in which each of the plurality of pump chambers increases in volumetric capacity along with rotation of the pump forming member, and discharge working oil via a discharge part formed in a discharge region in which each of the plurality of pump chambers decreases in volumetric capacity along with rotation of the pump forming member;

a biasing member mounted with application of a setting load so as to bias the swing member in a direction to increase a quantity of eccentricity between the center of the inside diameter of the swing member and the rotational center of pump forming member, the biasing member including a single spring;

a first seal member defined at an outer peripheral surface of the swing member, and being in contact with the inner periphery of the pump housing;

a second seal member defined at an outer peripheral surface of the swing member farther from the swing fulcrum than the outer peripheral surface where the first seal member is defined, wherein the second seal member is in contact with the inner periphery of the pump housing;

a first control oil chamber formed between the inner periphery of the pump housing and the swing member and between the swing fulcrum disposed in the discharge region and the first seal member, wherein movement of the swing member in a direction to reduce the quantity of eccentricity by supply of working oil to the first control oil chamber causes an increase in volumetric capacity of the first control oil chamber; and a second control oil chamber formed between the inner periphery of the pump housing and the swing member and between the swing fulcrum and the second seal member, wherein movement of the swing member in a direction to increase the quantity of eccentricity by supply of working oil to the second control oil chamber causes an increase in volumetric capacity of the second control oil chamber;

wherein the swing member includes a first pressure-receiving surface facing the first control oil chamber, and a second pressure-receiving surface facing the second control oil chamber, wherein the second pressure-receiving surface has a larger area than the first pressure-receiving surface.

11. The variable displacement oil pump as claimed in claim 10, further comprising a switching mechanism configured to switch between supply of the discharged working oil to the second control oil chamber and drain of working oil from the second control oil chamber.

* * * * *